US009972240B2

(12) United States Patent
Hsu et al.

(10) Patent No.: US 9,972,240 B2
(45) Date of Patent: May 15, 2018

(54) DISPLAY DEVICE AND METHOD FOR DRIVING THE SAME

(71) Applicant: AU Optronics Corporation, Hsin-Chu (TW)

(72) Inventors: Che-Ming Hsu, Hsin-Chu (TW); Chih-Cheng Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 76 days.

(21) Appl. No.: 14/834,788

(22) Filed: Aug. 25, 2015

(65) Prior Publication Data

US 2016/0063963 A1 Mar. 3, 2016

(30) Foreign Application Priority Data

Aug. 26, 2014 (TW) ..... 103129394 A

(51) Int. Cl.
*G09G 5/18* (2006.01)
*G09G 3/3225* (2016.01)
*G09G 3/20* (2006.01)

(52) U.S. Cl.
CPC ..... *G09G 3/3225* (2013.01); *G09G 3/2011* (2013.01); *G09G 2310/0251* (2013.01); *G09G 2310/08* (2013.01)

(58) Field of Classification Search
CPC .. G09G 3/3225; G09G 3/2011; G09G 3/2014; G09G 3/2018; G09G 3/12; G09G 3/30; G09G 3/36; G09G 3/3233; G09G 3/3291
See application file for complete search history.

(56) References Cited

U.S. PATENT DOCUMENTS 8,115,707 B2 2/2012 Nathan et al.
8,773,332 B2 * 7/2014 Nieh ..... G09G 3/3233 345/36
9,727,186 B2 * 8/2017 Yang ..... G06F 3/044
2006/0221701 A1 10/2006 Sun
2006/0227638 A1 10/2006 Kudo et al.
2010/0149157 A1 6/2010 Shih et al.
2010/0165011 A1 7/2010 Kudo et al.
2011/0316892 A1 * 12/2011 Sung ..... G09G 3/3233 345/690
2012/0007842 A1 * 1/2012 Nathan ..... G09G 3/3233 345/204
2013/0106823 A1 * 5/2013 Kishi ..... G09G 3/3258 345/211
2013/0293525 A1 11/2013 Lee et al.
2014/0111406 A1 4/2014 Wang et al.
2015/0035734 A1 * 2/2015 Lee ..... G09G 3/3258 345/76
2015/0213757 A1 * 7/2015 Takahama ..... G09G 3/3291 345/691

FOREIGN PATENT DOCUMENTS

CN 102779477 11/2012
TW I427381 2/2014

* cited by examiner

*Primary Examiner* — Jennifer Mehmood
*Assistant Examiner* — Sardis F Azongha
(74) *Attorney, Agent, or Firm* — WPAT, PC

(57) ABSTRACT

A method for driving a display device includes steps of providing a data signal in a first scan period and maintaining a level of the data signal until a second scan period, and providing a scan signal in the first scan period and maintaining a level of the scan signal until the second scan period. A display device is also disclosed herein.

18 Claims, 9 Drawing Sheets

DISPLAY DEVICE AND METHOD FOR DRIVING THE SAME

RELATED APPLICATIONS

This application claims priority to Taiwan Application Serial Number 103129394, filed Aug. 26, 2014, which is herein incorporated by reference.

BACKGROUND

Field of Invention

The present invention relates to a device and a method for driving the same. More particularly, the present invention relates to a display device and a method for driving the same.

Description of Related Art

In display panels, there is variability among thin-film transistors (TFTs) or organic light-emitting diodes (OLEDs) employed in display panels due to the manufacturing process. Hence, display panels need compensation circuits to compensate for the TFTs or the OLEDs so as to minimize the harmful effect to display panels due to such variability.

Compensation circuits employ different drive means in many compensating periods to achieve the goal of compensating display panels. In the foregoing compensating periods, a data driver is regarded as one of the most important control elements of such drive means for controlling the supply and switching of data signals.

If the data driver changes the level of its signals frequently, data lines will be charged and discharged correspondingly. As a result, the power consumption in the data lines will be extremely large, and the data driver will be overheated.

In view of the foregoing, problems and disadvantages are associated with existing products that require further improvement. However, those skilled in the art have yet to find a solution.

SUMMARY

The following presents a simplified summary of the disclosure in order to provide a basic understanding to the reader. This summary is not an extensive overview of the disclosure and it does not identify key/critical elements of the present invention or delineate the scope of the present invention.

One aspect of the present disclosure is directed to a method for driving a display device. The method includes the following steps:

providing a data signal in a first scan period and maintaining a level of the data signal until a second scan period; and providing a scan signal in the first scan period and maintaining a level of the scan signal until the second scan period.

According to one embodiment of the present disclosure, the step of providing the data signal in the first scan period includes providing the data signal with a first high level in the first scan period. The method for driving a display device further includes changing a level of the data signal from the first high level to a second high level in the second scan period.

According to another embodiment of the present disclosure, the time length of the first scan period is equal to the time length of the second scan period.

According to yet another embodiment of the present disclosure, the time length of the first scan period is M times the time length of the second scan period, where M is a positive integer.

According to still another embodiment of the present disclosure, the level of the data signal in the first scan period is different from the level of the data signal in the second scan period.

According to yet another embodiment of the present disclosure, the first scan period and the second scan period are a reset period or a compensating period. If the level of the scan signal is at a low level, the level of the data signal is at a high level; if the level of the scan signal is at a high level, the level of the data signal is at a low level.

According to another embodiment of the present disclosure, wherein the second scan period is a data writing-in period, the level of the scan signal is kept at a high level for a predetermined time.

According to yet another embodiment of the present disclosure, the method for driving a display device further includes changing the level of the data signal and/or the scan signal in the second scan period.

According to still another embodiment of the present disclosure, the first scan period is a data voltage maintaining period, and the second scan period is a data voltage changing period. The method for driving a display device further includes providing single scan signal pulse in a scan signal changing cycle, wherein the scan signal changing cycle comprises the data voltage maintaining period and the data voltage changing period, and wherein the data voltage changing period follows the data voltage maintaining period.

According to yet another embodiment of the present disclosure, the scan signal changing cycle further includes a second data voltage maintaining period. The method for driving a display device further includes providing the data signal with a first level in the data voltage maintaining period, and providing the data signal with a second level in the second data voltage maintaining period, wherein the voltage value of the first level is not equal to the voltage value of the second level, wherein a sequence of the periods in the scan signal changing cycle is the data voltage maintaining period, the second data voltage maintaining period, and the data voltage changing period.

According to still another embodiment of the present disclosure, the scan signal changing cycle further includes a second data voltage changing period, and a sequence of the periods in the scan signal changing cycle is the data voltage maintaining period, the data voltage changing period, and the second data voltage changing period.

According to yet another embodiment of the present disclosure, the scan signal changing cycle further includes a second data voltage changing period. The sequence of the periods in the scan signal changing cycle is the second data voltage changing period, the data voltage maintaining period, and the data voltage changing period.

Another aspect of the present disclosure is directed to a method for driving a display device, and the display device includes a data driver. The method includes the following steps:

providing a signal with a first level in a first scan period and maintaining the level of the signal in the first scan period by the data driver; and providing the signal with a second level in a second scan period and changing the level of the signal from the second level to a third level in the second scan period by the data driver, wherein the time length of the first scan period is equal to the time length of the second scan period, wherein the time length of the first level and the second level of the signal is longer than the time length of the third level of the signal.

According to one embodiment of the present disclosure, the signal with the first level and the second level is a data signal, and the signal with the third level is a reference signal. The time length of the data signal provided by the data driver is longer than the time length of the reference signal provided by the data driver in the first scan period and the second scan period.

According to another embodiment of the present disclosure, the method further includes providing the signal with a fourth level in a third scan period and maintaining the level of the signal in the third scan period by the data driver, and providing the signal with a fifth level in a fourth scan period and changing the level of the signal from the fifth level into a sixth level in the fourth scan period by the data driver. The time length of the fourth level and the fifth level of the signal is longer than the time length of the third level of the signal, or the time length of the fourth level and the fifth level of the signal is longer than the time length of the sixth level of the signal.

According to yet another embodiment of the present disclosure, the signal with the first level, the second level, the fourth level and the fifth level is a data signal, and the signal with the third level and the sixth level is a reference signal. The time length of the data signal between any of two adjacent reference signals provided by the data driver is longer than the time length of any reference signal provided by the data driver.

Still another aspect of the present disclosure is directed to a display device. The display device includes a gate driver, a data driver, and N pixels. Each of the N pixels includes a switching transistor, a driving transistor, and a light-emitting element. With respect to connections, the N pixels are configured to be electrically connected to the data driver and the gate driver, and the driving transistor is configured to be electrically connected to the switching transistor. The light-emitting element is configured to be electrically connected to the driving transistor. With respect to operation, the gate driver is configured to provide N scan signals, where N is an integer which is larger than one. The data driver is configured to provide a reference signal. The N pixels are driven according to the N scan signals respectively. The switching transistor is configured to receive the reference signal according to one of the N scan signals. The driving transistor is configured to receive the reference signal from the switching transistor. The light-emitting element is configured to be driven by the driving transistor. The switching transistors of the N pixels further provide the reference signal to corresponding driving transistors in a first period according to the N scan signals respectively. The data driver provides N data signals with different levels to the driving transistors of the N pixels in N different periods, respectively, and at least two periods of the N different periods are connected to each other.

According to one embodiment of the present disclosure, the time length of the at least two periods connected to each other is longer than or equal to two times the time length of the first period.

According to another embodiment of the present disclosure, the switching transistors of the N pixels are configured to respectively provide the reference signal to corresponding driving transistors in a second period according to the N scan signals. The at least two periods connected to each other are connected to the first period, and the second period is connected to the at least two periods connected to each other of the N different periods.

According to yet another embodiment of the present disclosure, the switching transistors of the N pixels are configured to provide the reference signal to corresponding driving transistors many times in a frame cycle according to the N scan signals in a frame cycle.

In view of the foregoing, embodiments of the present disclosure provide a display device and a method for driving a display device so as to improve the problem of large power consumption generation in data lines and scan lines and improve the problem of overheating of a data driver and a gate driver due to the data driver and the gate driver changing their signals frequently.

These and other features, aspects, and advantages of the present invention, as well as the technical means and embodiments employed by the present invention, will become better understood with reference to the following description in connection with the accompanying drawings and appended claims.

BRIEF DESCRIPTION OF THE DRAWINGS

The invention can be more fully understood by reading the following detailed description of the embodiment, with reference made to the accompanying drawings as follows.

Figure 1A:
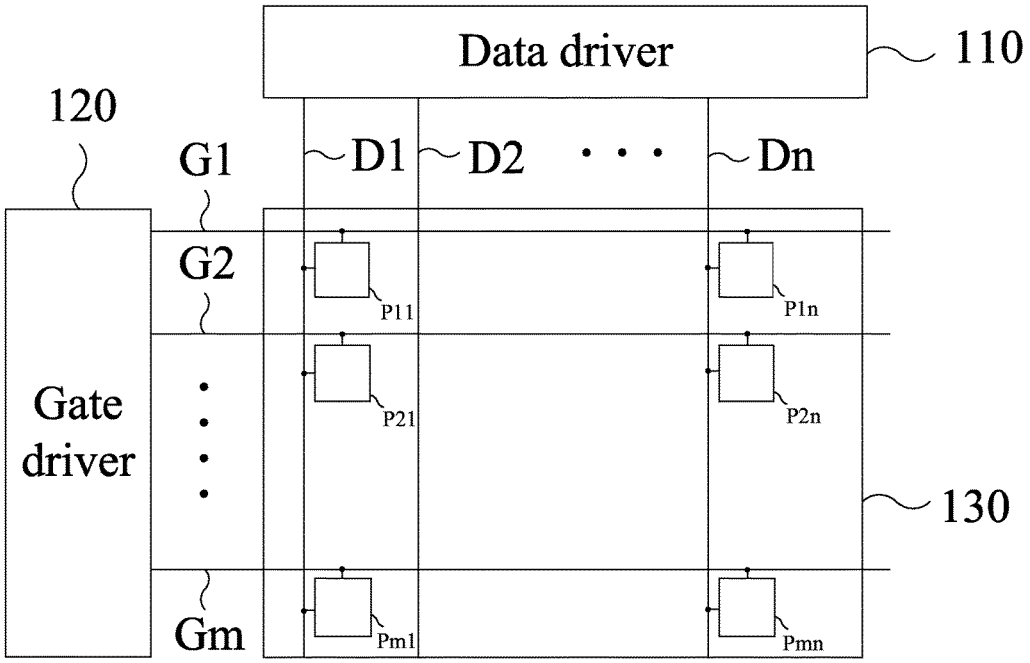
FIG. 1A is a schematic diagram of a display device according to embodiments of the present invention.

In accordance with common practice, the various described features/elements are not drawn to scale but instead are drawn to best illustrate specific features/elements relevant to the present invention. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present examples may be constructed or utilized. The description sets forth the functions of the examples and the sequence of steps for constructing and operating the examples. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include singular forms of the same.

For overcoming the problems associated with high power consumption and a data driver of a display device overheating due to the data driver changing the level of its signals frequently, the present invention provides a display device and a method for driving the same. The display device and the method for driving the same are used to adjust driving modes of data signals so as to reduce changing times of data signals; therefore, the power consumption in data lines can be decreased for achieving the goal of saving power. A detailed description regarding the display device and the method for driving the same of the present invention will be disclosed below.

FIG. 1A is a schematic diagram of a display device according to embodiments of the present invention. The display device includes a data driver 110, a gate driver 120, and a display panel 130. The data driver 110 is electrically connected to the display panel 130 through data lines D1~Dn, and the gate driver 120 is electrically connected to the display panel 130 through gate lines G1~Gm. In addition, the display panel 130 includes pixels P11~Pmn. The pixels P11~Pmn are electrically connected to the data driver 110 and the gate driver 120. The pixels P11~Pmn are driven according to m scan signals respectively.

Figure 1B:
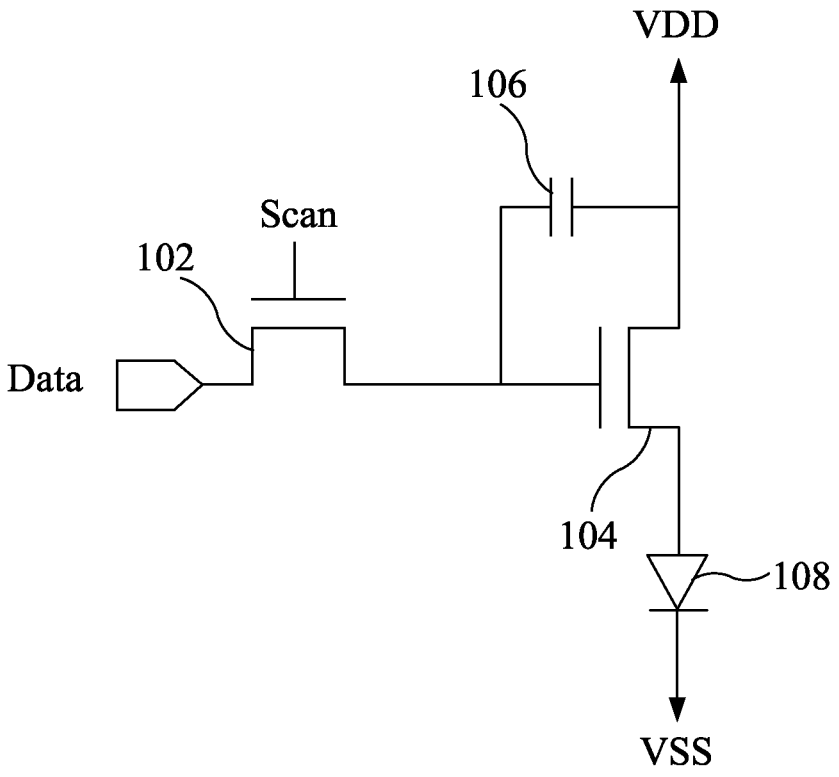
FIG. 1B is a pixel driving circuit diagram of the display device as shown in FIG. 1A according to embodiments of the present invention.

In addition, FIG. 1B is a pixel driving circuit diagram of the display device as shown in FIG. 1A according to embodiments of the present invention. As shown in FIG. 1B, each of the pixels P11~Pmn in the display panel 130 includes a switching transistor 102, a driving transistor 104, a storing capacitor 106, and a light-emitting element 108 (for example, a light-emitting diode). With respect to connections, the driving transistor 104 is electrically connected to the switching transistor 102, and the light-emitting element 108 is electrically connected to the driving transistor 104. With respect to operation, the switching transistor 102 is turned on or turned off according to one of scan signals Scan outputted from the gate driver 120. If the switching transistor 102 is turned on, the switching transistor 102 provides data signals Data outputted from the data driver 110 to the driving transistor 104, and the driving transistor 104 drives the light-emitting element 108 based on the data signals Data.

In one embodiment, the display device can be an electroluminescent display device, for example, an active-matrix organic light-emitting diode (AMOLED) display device, a plasma display panel, a liquid crystal display panel, etc. Moreover, the transistor can be a bipolar junction transistor (BJT), a metal-oxide-semiconductor field-effect transistor (MOSFET), or an insulated gate bipolar transistor (IGBT), but is not limited in this regard. Furthermore, the pixel driving circuit in the display device as shown in FIG. 1A can also be other kinds of pixel driving circuits, as long as the pixel driving circuits can receive data signals according to scan signals, and the pixel driving circuits can drive light-emitting diodes according to data signals. For example, the driving circuit as disclosed in US Patent Application Publication No. US 2012/0098810 A1 is one such kind of pixel driving circuit.

Figure 1C:
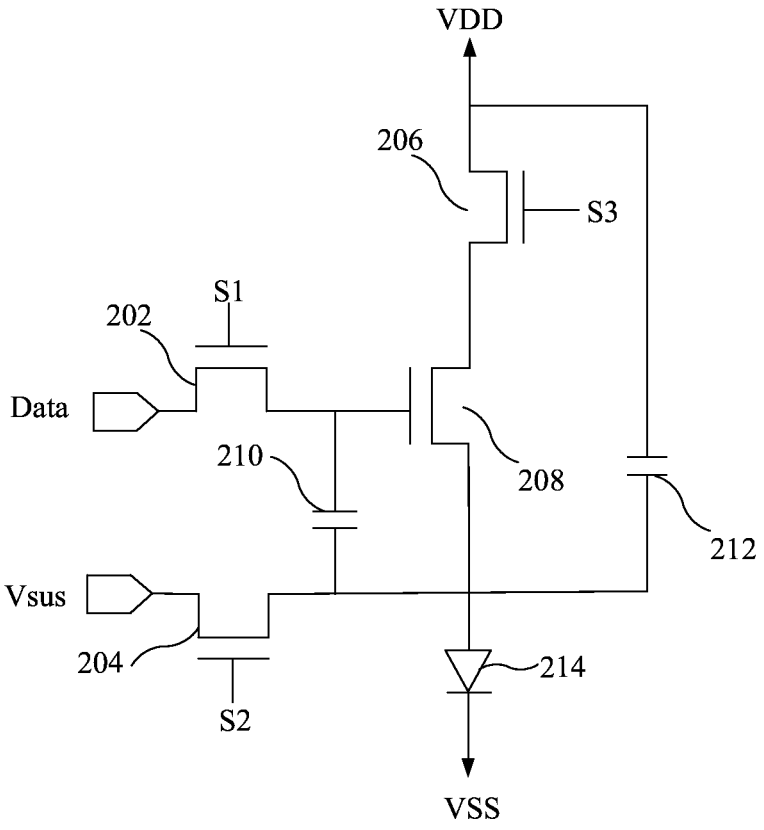
FIG. 1C is a pixel driving circuit diagram of the display device as shown in FIG. 1A according to embodiments of the present invention.
Figure 1D:
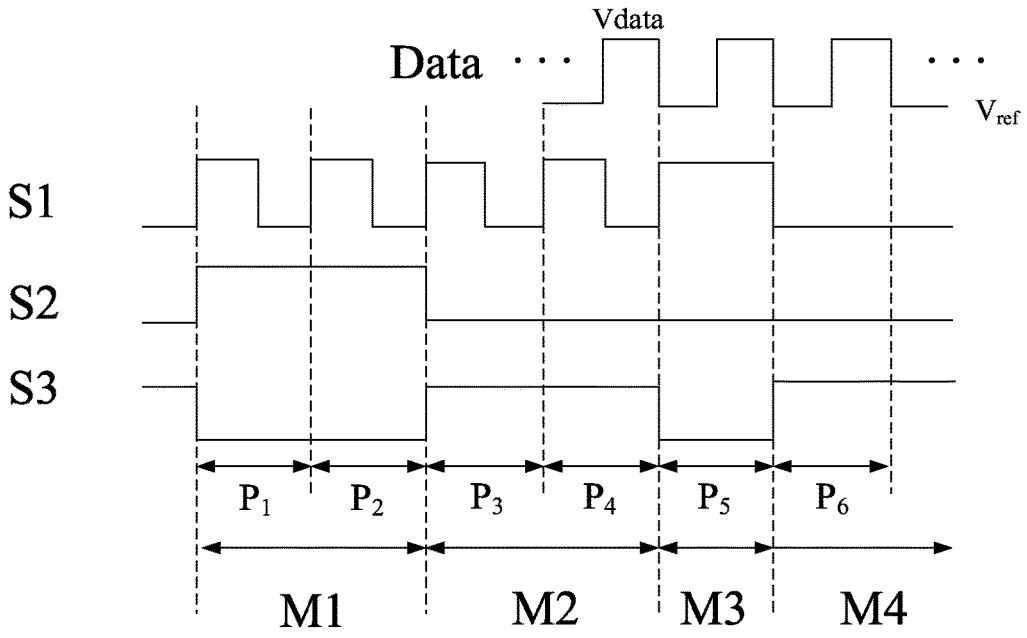
FIG. 1D is a schematic diagram of a driving waveform according to embodiments of the present invention.

FIG. 1C is a pixel driving circuit diagram of the display device as shown in FIG. 1A according to embodiments of the present invention. FIG. 1D is a schematic diagram of a driving waveform according to embodiments of the present invention. Referring to FIG. 1C, the pixel circuit includes a first transistor 202, a second transistor 204, a third transistor 206, a fourth transistor 208, a first capacitor 210, a second capacitor 212, and a light-emitting element 214. The first transistor 202, the second transistor 204, and the third transistor 206 respectively receive scan signals S1~S3, and these transistors 202, 204, 206 are turned on or turned off based on the scan signals S1~S3. As a result, the first transistor 202, the second transistor 204, and the third transistor 206 can receive a data voltage Data, a voltage Vsus, and a power supply voltage VDD so as to charge or discharge the first capacitor 210 and second capacitor 212; therefore, the fourth transistor 208 can be controlled to drive the light-emitting element 214.

Referring to both FIGS. 1C and 1D, in order to avoid a situation in which the pixel circuit is affected by the threshold voltage of transistors inside the pixel circuit, the embodiment of the present invention employs the drive method shown in FIG. 1D to perform compensation with respect the pixel circuit. The foregoing drive method has four modes, including a reset period M1 (Reset), a compensating period M2 (Compensation), a data writing-in period M3 (Data input), and an emitting period M4 (Emission). After the operations of the foregoing four modes, compensation with respect to the pixel circuit of the display device is complete, such that the pixel circuit of the display device will not be affected by the threshold voltage of its driving transistors.

However, as shown in FIG. 1D, data voltages Data in each scan period (for example, scan periods $P_4$~$P_6$) need to be changed once for writing the reference signal $V_{ref}$ and the data signal Vdata into pixels in each row based on the scan signal S1. The foregoing drive method charges and discharges data lines frequently. As a result, the power consumption generation in the data lines is extremely large. For solving the above-mentioned problem, the present invention further provides a display device and a method for driving the same, and the detailed embodiments thereof are described below.

Figure 2:
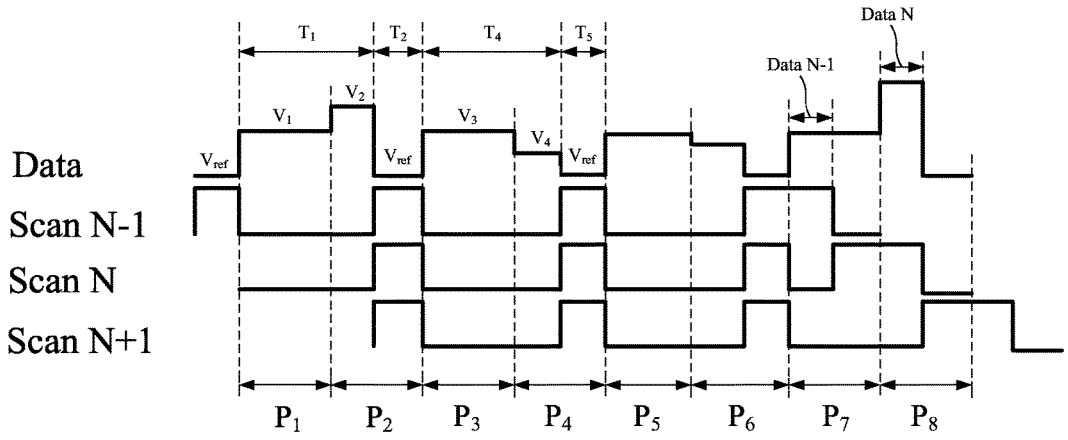
FIG. 2 is a schematic diagram of a driving waveform according to embodiments of the present invention.

The driving method of the embodiment of the present invention can be performed by the display device as shown in FIG. 1A. However, the driving method is not limited to be performed only by the kind of the display device as shown in FIG. 1A, and the following embodiment is merely used to introduce this invention. Moreover, the driving waveform as shown in FIG. 2 illustrates a driving waveform that is controlled by the driving method. As can be seen in FIG. 2, a driving mode of the driving method is clearly illustrated therein, and this will be described in detail below. The data signal shown in FIG. 2 is the data signal Data outputted by the data driver 110. Scan N−1, Scan N and Scan N+1 are scan signals received by the switching transistor 102 or the first transistor 202 of the pixel driving circuit in different rows.

Reference is now made to FIG. 1A and FIG. 2. First of all, the driving method is performed with the data driver 110 to output a data signal Data in the scan period $P_1$ and maintain the level $V_1$ of the data signal Data until the scan period $P_2$. As can be seen in FIG. 2, the driving method is performed with the data driver 110 to control the level of the data signal Data, such that the level of the data signal Data can be kept at the level $V_1$ in the scan period $P_1$ until the beginning of the scan period $P_2$. Subsequently, the level of the data signal Data will be changed at the beginning of the scan period $P_2$. For example, the driving method is performed with the data driver 110 to change the level of the data signal Data from the level $V_1$ to the level $V_2$ at the beginning of the scan period $P_2$. Similarly, the driving method is performed with the data driver 110 to output the data signal Data in the scan period $P_3$ and maintain the level $V_3$ of the data signal Data until the scan period $P_4$. Furthermore, the manner of controlling the data signal Data in the following scan periods of FIG. 2 is similar to the manner of controlling the data signal Data in the scan periods $P_1$~$P_4$. Therefore, a detailed description regarding the following scan periods is omitted herein for brevity.

Specifically, in the scan period $P_1$, the level of the data signal Data is kept at the level $V_1$ for providing display data to pixels in one of the rows. In the scan period $P_2$ which is adjacent to the scan period $P_1$, the level of the data signal Data is changed to the level $V_2$ for providing display data to pixels in the next row. Subsequently, the level of the data signal Data is changed to the level $V_{ref}$ in the scan period $P_2$ for providing reference signals $V_{ref}$ to pixels in many rows. In other words, the data signal Data can continuously provide data levels for displaying in sequential scan periods. Therefore, the data signal Data does not have to change its level between a displaying data level and a reference signal $V_{ref}$, and there is no additional power consumption due to level changing of the data signal Data. Moreover, pixels in many rows can be reset according to the reference signal $V_{ref}$ at the same period.

To summarize the driving waveform in FIG. 2, the driving method of the present invention is performed to control the level of the data signal Data, such that the level of the data signal Data is kept at the same level in odd scan periods (for example, the scan period $P_1$, the scan period $P_3$, and so on). In other words, the level of the data signal Data is not changed in odd scan periods, and is changed only in even scan periods (for example, the scan period $P_2$, the scan period $P_4$, and so on). In contrast to changing the level of the data signal Data in each scan period, the driving method of the present invention is performed to control the data signal Data to change its level in even scan periods. Therefore, the data lines of the display device will not be charged and discharged frequently so as to decrease power consumption in data lines for saving power.

It is noted that the driving waveform as shown in FIG. 2 is one of the embodiments which the driving method of the present invention can perform, and the present invention is not intended to be limited thereto. Specifically, regarding the driving waveform in FIG. 2, the level of the data signal Data is kept at the same level every other scan period. For example, the level of the data signal Data is kept at the same level in the scan period $P_1$; after the scan period $P_2$, the level of the data signal Data is kept at the same level in the scan period $P_3$ again. With respect to the changing of signals, the data signal Data of the driving waveform in FIG. 2 is changed every other scan period. However, the present invention is not limited to maintaining the level of the data signal Data every other scan period or not limited to changing the level of data signal Data every other scan period. The driving method of the present invention can be performed to maintain the level of the data signal Data every two scan periods (for example, the level of the data signal Data is kept at the same level in the first scan period, and after the second scan period and the third scan period, the level of the data signal Data is kept at the same level in the fourth scan period again, i.e., the level of the data signal Data will be changed every two scan periods). Moreover, the level of the data signal Data can be kept at the same level in some of the scan periods depending on actual requirements.

In view of above, the present invention involves maintaining the level of the data signal Data at the same level in a portion of the scan periods for reducing the changing times of the signals so as to achieve the goal of saving power. Therefore, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

Furthermore, as shown in FIG. 2, the driving method is performed with the data driver 110 to provide different levels of the data signal Data in each scan period $P_1$~$P_8$ for displaying images with different gray levels. For example, the driving method can be performed with the data driver 110 to provide the data signal Data with the level $V_1$ in the scan period $P_1$. Subsequently, the driving method is performed with the data driver 110 to provide the data signal Data with the level $V_2$ in the scan period $P_2$ for displaying images with different gray levels. In another embodiment, the driving method is further performed with the data driver 110 to provide the data signal Data with the level $V_1$ in both the scan periods $P_1$ and $P_2$ for displaying images with the same gray level. In view of the above, the driving method can be performed with the data driver 110 to provide the data signal Data with the same level or different levels in each scan period $P_1$~$P_8$ for displaying images with the same gray level or with different gray levels. Hence, the present invention is not intended to be limited to the waveform as shown in FIG. 2. The real drive method depends on actual requirements.

Reference is now made to FIG. 1A and FIG. 2. The driving method can be performed with the data driver 110 to change the level of the data signal Data every other scan period. Accordingly, the driving method can be performed with the gate driver 120 to turn on a corresponding transistor every other scan period. That is to say, the driving method can be performed with the gate driver 120 to output a turn-on signal every other scan period. Therefore, compared with providing a turn-on signal in every scan period, the driving method of the present invention is performed to output a turn-on signal every other scan period to thereby reduce power consumption in scan lines so as to save power. Similarly, the waveform as shown in FIG. 2 is one of the embodiments which the driving method of the present invention can perform, and the present invention is not intended to be limited thereto.

Reference is now made to FIG. 1A and FIG. 2. In one embodiment, the driving method is further performed with the data driver 110 to output a signal with the level $V_2$ in the scan period $P_2$, and the level of the signal is changed from the level $V_2$ to the level $V_{ref}$ in the scan period $P_2$. In this embodiment, the time length of the scan period $P_1$ is equal to the time length of the scan period $P_2$. Moreover, the time length $T_1$ of the level $V_1$ and the level $V_2$ of the signal provided by the data driver 110 is longer than the time length $T_2$ of the level $V_{ref}$ of the signal provided by the data driver 110.

Reference is now made to FIG. 1B and FIG. 2. In another embodiment, the signal with the level $V_1$ and the level $V_2$ is a data signal. The driving transistor 104 can drive the light-emitting element 108 based on the data signal for displaying images with different gray levels. In addition, the signal with the level $V_{ref}$ is a reference signal. The reference signal is a voltage which is used to be written in the capacitor of the pixel circuit in the display device for performing compensation with respect to the pixel circuit of the display device. In this embodiment, referring to FIG. 1A and FIG. 2, the time length $T_1$ of the data signal provided by the data driver 110 is longer than the time length $T_2$ of the reference signal provided by the data driver 110 in the scan period $P_1$ and the scan period $P_2$.

Reference is now made to FIG. 1A and FIG. 2. In yet another embodiment, the driving method is further performed with the data driver 110 to output a signal with the level $V_3$ in the scan period $P_3$ and maintain the level of the signal at the same level in the scan period $P_3$. The driving method is further performed with the data driver 110 to output a signal with the level $V_4$ in the scan period $P_4$ and change the level of the signal from the level $V_4$ to the level $V_{ref}$. In this embodiment, the time length $T_4$ of the level $V_3$ and the level $V_4$ of the signal provided by the data driver 110 is longer than the time length $T_2$ or the time length $T_5$ of the level $V_{ref}$ of the signal provided by the data driver 110.

Reference is now made to FIG. 1A and FIG. 2. In another embodiment, the signal with the level $V_1$~$V_4$ is a data signal, and the signal with the level $V_{ref}$ is a reference signal. As a result, the time length $T_4$ of the data signal between any of two adjacent reference signals (for example, the reference signal in the scan period $P_2$ and the reference signal in the scan period $P_4$) provided by the data driver 110 is longer than the time length of any reference signal (for example, the reference signal in the scan period $P_2$ or the reference signal in the scan period $P_4$) provided by the data driver 110.

Figure 3:
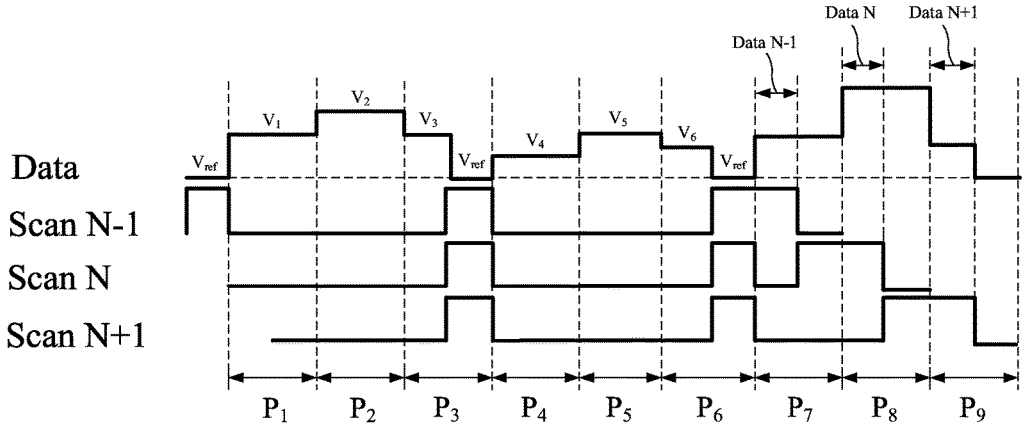
FIG. 3 is a schematic diagram of a driving waveform according to embodiments of the present invention.
Figure 4:
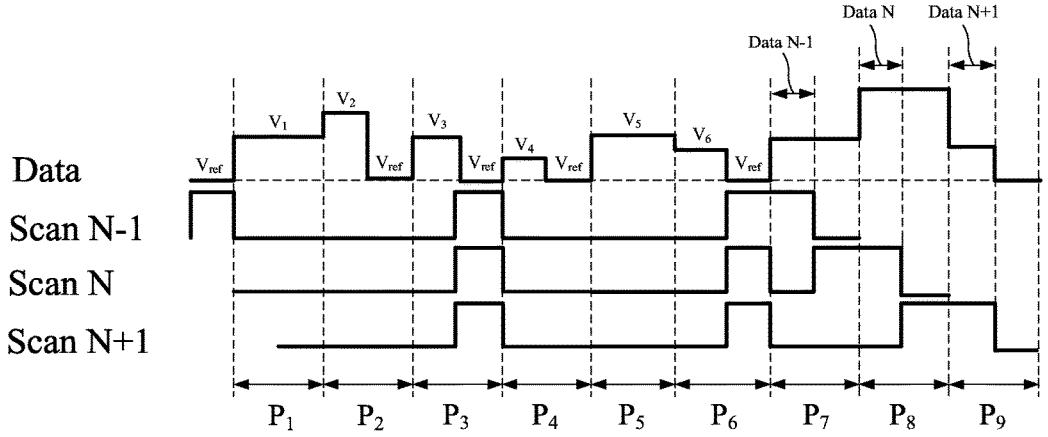
FIG. 4 is a schematic diagram of a driving waveform according to embodiments of the present invention.

FIG. 3 is a schematic diagram of a driving waveform according to embodiments of the present invention. FIG. 4 is a schematic diagram of a driving waveform according to embodiments of the present invention. It is noted that basic operations of the driving waveforms of FIG. 3 and FIG. 4 are similar to those of FIG. 2; therefore, a description of the basic operations of the driving waveforms of FIG. 3 and FIG. 4 will be omitted herein for brevity. Only the difference of the operations between FIG. 2 and FIG. 3-4 will be described herein. The scan period $P_1$, the scan period $P_2$, and the scan period $P_3$ in FIG. 3 can be defined as a scan signal changing cycle (or a gate voltage changing cycle). Similarly, the scan period $P_4$, the scan period $P_5$, and the scan period $P_6$ can be also defined as a scan signal changing cycle. In the scan signal changing cycle, a single scan signal pulse is outputted. Furthermore, the scan signal changing cycle includes a data voltage maintaining period and a data voltage changing period. For example, the scan period $P_1$ and the scan period $P_2$ can be defined as the data voltage maintaining period, and the scan period $P_3$ can be defined as the data voltage changing period. The level of the data voltage is kept at the same level in the data voltage maintaining period. In addition, the level of the data voltage is changed in the data voltage changing period.

As shown in FIG. 3, the scan signal changing cycle herein includes a plurality of data voltage maintaining periods (for example, the scan period $P_1$ and the scan period $P_2$) and a data voltage changing period (for example, the scan period $P_3$). On the other hand, as shown in FIG. 4, the scan signal changing cycle includes a data voltage maintaining period (for example, the scan period $P_1$) and a plurality of data voltage changing periods (for example, the scan period $P_2$ and the scan period $P_3$). As can be seen, the scan signal changing cycle in practice includes a plurality of data voltage maintaining periods and a data voltage changing period, includes a data voltage maintaining period and a plurality of data voltage changing periods, or includes a plurality of data voltage maintaining periods and a plurality of data voltage changing periods. As a result, the compositions in the scan signal changing cycle is not limited to the embodiments in FIG. 3 and FIG. 4, and the compositions in the scan signal changing cycle can be adaptively configured based on actual requirements.

In one embodiment, the data voltage changing period can be disposed in the last period of the scan signal changing cycle. As shown in FIG. 3 and FIG. 4, the scan period $P_3$ belongs to the data voltage changing period, and the scan period $P_3$ is disposed in the last period of the scan signal changing cycle (for example, the scan signal changing cycle is composed of the scan period $P_1$, the scan period $P_2$, and the scan period $P_3$). Furthermore, the sequence of the data voltage maintaining period and the data voltage changing period in the scan signal changing cycle can be adjusted depending on actual requirements. As shown in FIG. 4, the scan period $P_1$ and the scan period $P_5$ belong to the data voltage maintaining period. The scan period $P_2$ and the scan period $P_4$ belong to the data voltage changing period. In the scan signal changing cycle composed of the scan periods $P_1$~$P_3$, the data voltage maintaining period (the scan period $P_1$) is disposed before the data voltage changing period (the scan period $P_2$). However, in the scan signal changing cycle composed of the scan periods $P_4$~$P_6$, the data voltage maintaining period (the scan period $P_5$) is disposed after the data voltage changing period (the scan period $P_4$).

In another embodiment, the level of the data signal in the first half of the data voltage changing period can be kept at the same level, and the level of the data signal will be changed to the reference voltage in the latter half of the data voltage changing period. As shown in FIG. 3 and FIG. 4, the scan period $P_3$ belongs to the data voltage changing period. The level of the data signal is kept at the high level $V_3$ in the first half of the scan period $P_3$, and the level of the data signal is changed to the reference voltage $F_{ref}$. On the other hand, the first half of the scan period $P_3$ is 50% of the scan period $P_3$, and the latter half of the scan period $P_3$ is 50% of the scan period $P_3$. However, the present invention is not intended to be limited to the foregoing embodiment, and the foregoing embodiment is merely used to describe an example of the present invention. Actually, the rate of the first half and the latter half of the scan period $P_3$ can be adaptively adjusted depending on actual requirements. In other words, the duty cycle of the first half and the latter half of the scan period $P_3$ can be adaptively adjusted depending on actual requirements.

In another embodiment, referring to FIG. 3, among each of the data voltage maintaining periods, the level of the data signal Data is not kept at the same level. For example, the scan period $P_1$ and the scan period $P_2$ are all data voltage maintaining periods; however, in the scan period $P_1$, the level of data signal Data is $V_1$. In the scan period $P_2$, the level of data signal Data is $V_2$. As a result, among the scan period $P_1$ and the scan period $P_2$, the level of data signal Data is not kept at the same level. In other words, among the scan period $P_1$ and the scan period $P_2$, the levels of the data signal Data can be different. However, the present invention is not intended to be limited to the embodiment as described in FIG. 3, and the foregoing embodiment is merely used to describe the present invention. The level of the data signal Data in the data voltage maintaining period can be adaptively adjusted based on actual requirements.

Reference is now made to FIG. 1A, FIG. 1B, and FIG. 3. In another embodiment, the switching transistor 102 can receive the reference signal $V_{ref}$ according to one of the N scan signals provided by the gate driver 120. The driving transistor 104 can receive the reference signal $V_{ref}$ from the switching transistor 102 for driving the light-emitting element 108. The switching transistors 102 of the pixels P11~Pmn further provide the reference signals $V_{ref}$ to corresponding driving transistors 104 according to m scan signals in the first period.

For example, assuming that there are three switching transistors 102 disposed in three rows of the pixels of the display panel 130 respectively, these three switching transistors 102 are respectively turned on according to the scan signals Scan N−1, Scan N, and Scan N+1 in the latter half of the period $P_3$ in FIG. 3. Therefore, these three switching transistors 102 can receive the reference signal $V_{ref}$ outputted by the data driver 110 in the latter half of the period $P_3$, and these three switching transistors 102 can provide the reference signal $V_{ref}$ to corresponding three driving transistors 104 in the latter half of the period $P_3$ (for example, the switching transistor 102 in N−1 row provides the reference signal $V_{ref}$ to the driving transistor 104 in N−1 row, the switching transistor 102 in N row provides the reference signal $V_{ref}$ to the driving transistor 104 in N row, and so on). Hence, the pixels P11~Pmn of the display device of the present invention can be reset simultaneously.

On the other hand, as shown in the period $P_7$, the level of the scan signal Scan N−1 is high in the first half of the period $P_7$. The switching transistor 102 in N−1 row is turned on according to the scan signal Scan N−1 with a high level for providing the data signal Data N−1 to the driving transistor 104 in N−1 row. Moreover, as shown in the period $P_8$, the level of the scan signal Scan N is high in the first half of the period $P_8$. The switching transistor 102 in N row is turned on according to the scan signal Scan N with a high level for providing the data signal Data N to the driving transistor 104 in N row. Furthermore, as shown in the period $P_9$, the level of the scan signal Scan N+1 is a high level in the first half of the period $P_9$. The switching transistor 102 in N+1 row is turned on according to the scan signal Scan N+1 with a high level for providing the data signal Data N+1 to the driving transistor 104 in N+1 row.

Reference is now made to FIG. 1A, FIG. 1B, and FIG. 3. In yet another embodiment, the data driver 110 further provides the data signals with N different levels to the driving transistors 104 of the pixels P11~Pmn respectively in N different periods, and at least two periods of the N different periods are connected to each other. For example, the data driver 110 can provide data signals with levels $V_1$, $V_2$, $V_4$, $V_5$, and $V_3$ in corresponding periods $P_1$, $P_2$, $P_2$, $P_4$, $P_5$, and the first half of $P_3$ as shown in FIG. 3 to corresponding driving transistors 104 of the pixels P11~Pmn. In the foregoing periods, periods $P_1$, $P_2$ are connected to each other, and periods $P_4$, $P_5$ are connected to each other. In summary, the data driver 110 of the embodiment of the present invention can provide data signals with different levels in N different periods to the driving transistors 104 of the pixels P11~Pmn. Among data signals with N different levels in N different periods, two of data signals (for example, data signals $V_1$, $V_2$) can be connected to each other. In addition, two, three (for example, data signals $V_1$, $V_2$, $V_3$), or plural (for example, four or more of the data signals) of data signals can be connected to each other depending on actual requirements, such that a better driving mode can be provided for driving the pixels P11~Pmn so as to further save power.

Referring again to FIG. 1A, FIG. 1B, and FIG. 3, in still another embodiment, the time length of the at least two periods connected to each other is longer than or equal to two times the time length of one period. For example, the time length of the periods $P_1$, $P_2$ which are connected to each other is longer than or equal to two times the time length of the latter half of the periods $P_3$. Moreover, the time length of the periods $P_4$, $P_5$ which are connected to each other is longer than or equal to two times the time length of the latter half of the periods $P_6$.

Continued reference is made to FIG. 1A, FIG. 1B, and FIG. 3. In yet another embodiment, the switching transistors 102 of the pixels P11~Pmn further provide reference signals $V_{ref}$ to the corresponding driving transistors 104 according to N scan signals in the second period. At least two adjacent periods of N different periods, such as the first period and the second period, are connected to at least two periods connected to each other. For example, assuming there being three switching transistors 102 in three rows of the pixel array of the display panel 130, these three switching transistors 102 can be turned on respectively according to scan signals Scan N−1, Scan N, Scan N+1 in the latter half of the period $P_6$ as shown in FIG. 3. Therefore, these three switching transistors 102 can receive reference signals $V_{ref}$ outputted by the data driver 110 in the latter half of the period $P_6$, and these three switching transistors 102 provide reference signals $V_{ref}$ to the corresponding three driving transistors 104 in the latter half of the period $P_6$ (for example, the switching transistor 102 in N−1 row provides the reference signal $V_{ref}$ to the driving transistor 104 in N−1 row, the switching transistor 102 in N row provides the reference signal $V_{ref}$ to the driving transistor 104 in N row, and so on). Hence, the pixels P11~Pmn of the display device of the present invention can be reset simultaneously.

In this embodiment, the at least two adjacent periods of N different periods, such as the period $P_4$ and the period $P_5$ which are connected to each other, can be connected to the period $P_3$. On the other hand, the period $P_6$ can be connected to the periods $P_4$ and $P_5$ which are connected to each other.

Referring again to FIG. 1A, FIG. 1B, and FIG. 3, in another embodiment, the switching transistors 102 of pixels can further provide reference signals $V_{ref}$ to corresponding driving transistors 104 many times according to m scan signals in one frame cycle.

Figure 5:
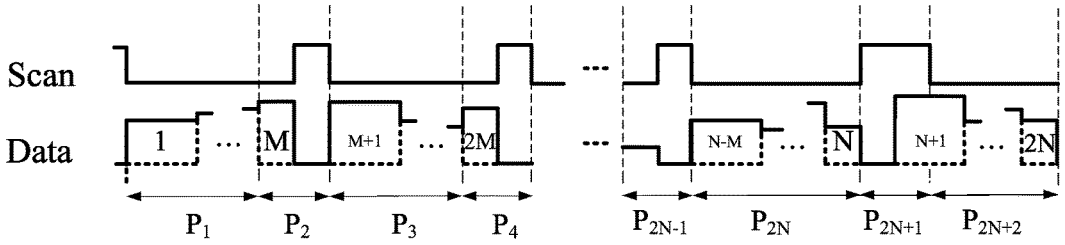
FIG. 5 is a schematic diagram of a driving waveform according to embodiments of the present invention.

FIG. 5 is a schematic diagram of a driving waveform according to embodiments of the present invention. Referring to FIG. 1A and FIG. 5, first of all, the driving concept of the driving waveform as shown in FIG. 5 is similar to that of the driving waveform as shown in FIG. 2, and will be described in detail below.

As shown in FIG. 5, the driving method is performed with the data driver 110 to output the data signal Data, and the level of the data signal Data is kept at the same level in the scan period $P_1$ until the scan period $P_2$. As shown in FIG. 5, the driving method of the present invention is performed to maintain the level of the data signal Data at a high level in the scan period $P_1$ until the scan period $P_2$, and the level of the data signal Data is changed from a high level to a low level in the scan period $P_2$. As can be seen in FIG. 5, the level of the data signal Data in the scan period $P_1$ is different from the level of the data signal Data in the scan period $P_2$.

Similarly, the driving method is performed with the data driver 110 to output the data signal Data and maintain the level of the data signal Data in the scan period $P_3$ until the scan period $P_4$. Moreover, the manner of controlling the data signal Data in the following scan periods of FIG. 5 is similar to the manner of controlling the data signal Data in scan periods $P_1$~$P_4$; therefore, a detailed description regarding the following scan periods is omitted herein for brevity. It is noted that the manner of controlling the data signal Data in the scan period $P_{2N+2}$ is different. Since the scan period $P_{2N+2}$ belongs to the data writing-in period, the data driver 110 needs to continuously output data signals Data for a period of time, such that data can be written into a pixel capacitor successfully.

Furthermore, the driving method is performed with the gate driver 120 to output the scan signal Scan and maintain the level of the scan signal Scan in the scan period $P_1$ until the scan period $P_2$. As shown in FIG. 5, the driving method of the present invention is performed to maintain the level of the scan signal Scan in the scan period $P_1$ until the scan period $P_2$, and the level of the scan signal Scan is changed in the scan period $P_2$. Similarly, the driving method is performed with the gate driver 120 to output the scan signal Scan and maintain the level of the scan signal Scan in the scan period $P_3$ until the scan period $P_4$. Therefore, similar to the driving concept of the driving waveform as shown in FIG. 2, in the embodiment of FIG. 5, the power consumption in data lines and scan lines can be reduced so as to save power.

In one embodiment, referring to the driving waveform in FIG. 2, the time lengths of the scan periods $P_1$~$P_8$ are equal.

Figure 6:
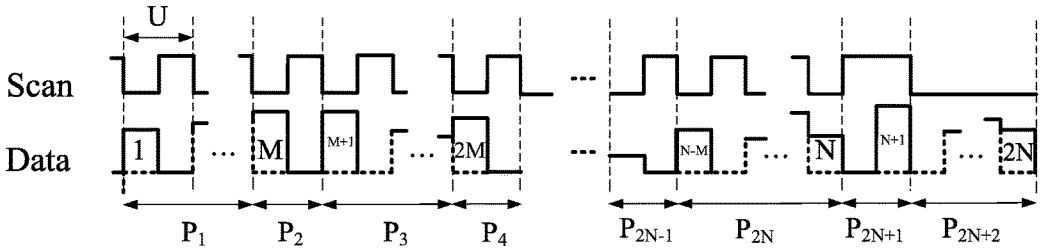
FIG. 6 is a schematic diagram of a driving waveform according to the prior art.

In another embodiment, the time length of the scan period $P_1$ is M times the time length of the scan period $P_2$ as shown in FIG. 5. Similarly, the time length of the scan period $P_3$ is M times that of the scan period $P_4$, and so on. M is a positive integer. In still another embodiment, if the scan period $P_2$ is regarded as a unit period and the scan period $P_1$ is divided based on the unit period, the scan period $P_1$ has M−1 unit periods. Moreover, the scan period $P_1$ and the scan period $P_2$ have M unit periods. FIG. 6 is a schematic diagram of a driving waveform according to the prior art. As shown in FIG. 6, the level of the data signal Data is changed at the adjoining point of two unit periods U, and the level of the data signal Data will be changed M times in the scan period $P_1$ and the scan period $P_2$. Compared with the above-mentioned prior art, in the embodiment of FIG. 5, the driving method is performed with the data driver 110 to maintain the level of the data signal Data at the same level in the scan period $P_2$; in other words, the level of the data signal Data is not changed to a low level in the scan period $P_1$. Hence, the level of the data signal Data is not changed in the scan period $P_1$ and the scan period $P_2$. Compared with the level of the data signal Data being changed M times in the prior art, the changing frequency of the data signal Data is reduced M times. Similarly, the driving method is performed with the gate driver 120 to decrease the changing frequency of the scan signal Scan M times. Therefore, in view of the fact that power consumption is directly proportional to the changing frequency, the driving method of the present invention decreases power consumption by 1/M times.

In one embodiment, assuming the scan period is the reset period or the compensating period, if the level of the scan signal is a low level, the level of the data signal is a high level, and if the level of the scan signal is a high level, the level of the data signal is a low level. For example, referring to FIG. 2, assuming the scan period $P_2$ is the reset period or the compensating period, if the level of the scan signal Scan N−1 is a low level, the level of the data signal Data is a high level, and if the level of the scan signal Scan N−1 is a high level, the level of the data signal Data is a low level. For example, the low level of the data signal Data can be the reference signal, and the reference signal is used for writing into the capacitor of the pixel circuit of the display device in order to compensate for the pixel circuit of the display device, such that the pixel circuit of the display device will not be affected by the threshold voltage of its driving transistor. Moreover, the situation in the driving waveform as shown in FIG. 5 is the same, and a detailed description will be omitted herein for brevity.

In another embodiment, if the scan period is the data writing-in period, the level of the scan signal is kept at a high level. For example, referring to FIG. 2, if the scan period $P_7$ is the data writing-in period, the level of the scan signal Scan N−1 will be kept at a high level for a period of time so as to write data into a pixel capacitor successfully.

In yet another embodiment, referring to FIG. 1A, the data driver 110 and the gate driver 120 transmit the data signal Data and the scan signal Scan to the display panel 130 through data lines D1~Dn and gate lines G1~Gm respectively. However, the RC loading in data lines D1~Dn and gate lines G1~Gm will lead to distortion of the data signal Data and the scan signal Scan. The driving method of the present invention is performed to maintain the level of the data signal Data. Therefore, compared with changing the level of the data signal Data frequently, an efficient data signal Data which is provided by the data driver 110 in the present invention can be extended. Hence, the display panel 130 can receive a correct data signal Data.

Those having skill in the art will appreciate that the method for driving a display device can be performed with software, hardware, and/or firmware. For example, if an implementer determines that speed and accuracy are paramount, the implementer may opt for a mainly hardware and/or firmware implementation; alternatively, if flexibility is paramount, the implementer may opt for a mainly software implementation; or, yet again alternatively, the implementer may opt for some combination of hardware, software, and/or firmware. Those skilled in the art will recognize that optical aspects of implementations will typically employ optically oriented hardware, software, and or firmware.

In addition, those skilled in the art will appreciate that each of the steps of the method for driving a display device named after the function thereof is merely used to describe the technology in the embodiment of the present invention in detail, but the present disclosure is not limited in this regard. Therefore, combining the steps of said method into one step, dividing the steps into several steps, or rearranging the order of the steps is within the scope of the embodiment in the present invention.

In the above-mentioned embodiments of the present invention, data lines of a display device provide data signals to pixels in different rows in many continuous periods. Since pixels in adjacent rows will display similar images, the voltage changing rate in data lines or data drivers is small. Compared with the prior art (where after providing data signals to pixels, the level of the data signals will be changed to the level of reference signals), the embodiments of the present invention do not have to change the level of data signals to the level of reference signals frequently so that power consumption associated with the embodiments of the present invention is low.

In view of the above embodiments of the present disclosure, it is apparent that the application of the present invention has a number of advantages. The present invention provides a display device and a method for driving a display device so as to improve the problem of large power consumption generation in data lines and scan lines and so as to improve the problem of overheating of a data driver and a gate driver due to the data driver and the gate driver changing their signals frequently.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A method for driving a display device, wherein the display device comprises N pixels, and each of the N pixels comprises a switching transistor, a driving transistor and a light-emitting element connected to the driving transistor in series, comprising:

switching a data signal from a reference level to a first level and providing the data signal with the first level in a first scan period and maintaining the first level of the data signal until a second scan period, wherein the data signal is provided to a gate electrode of the driving transistor through the switching transistor;

providing a scan signal to the switching transistor in the first scan period and maintaining a level of the scan signal until the second scan period; and changing a level of the data signal from the first level to a second level to provide to the driving transistor through the switching transistor in a first period in the second scan period, and changing a level of the data signal from the second level to the reference level in a second period in the second scan period, wherein the second period follows the first period, wherein the scan signal in the first scan period disables the switching transistor until the scan signal in the second scan period enables the switching transistor when the level of the data signal changes from the second level to the reference level.

2. The method for driving a display device of claim 1, wherein a time length of the first scan period is equal to a time length of the second scan period.

3. The method for driving a display device of claim 1, wherein a time length of the first scan period is M times a time length of the second scan period, where M is a positive integer.

4. The method for driving a display device of claim 1, wherein the level of the data signal in the first scan period is different from the level of the data signal in the second scan period.

5. The method for driving a display device of claim 1, wherein the first scan period and the second scan period are a reset period or a compensating period, when the level of the scan signal is at a low level, the level of the data signal is at a high level, and when the level of the scan signal is at a high level, the level of the data signal is at a low level.

6. The method for driving a display device of claim 1, wherein the second scan period is a data writing-in period, the level of the scan signal is kept at a high level for a predetermined time.

7. The method for driving a display device of claim 1, wherein the first scan period is a data voltage maintaining period, and the second scan period is a data voltage changing period; and wherein the method for driving a display device further comprises:

providing a single scan signal pulse in a scan signal changing cycle, wherein the scan signal changing cycle comprises the data voltage maintaining period and the data voltage changing period, wherein the data voltage changing period follows the data voltage maintaining period.

8. The method for driving a display device of claim 7, wherein the scan signal changing cycle further comprises a second data voltage maintaining period, wherein the method for driving a display device further comprises:

providing the data signal with a first level in the data voltage maintaining period; and providing the data signal with a second level in the second data voltage maintaining period, wherein the voltage value of the first level is not equal to the voltage value of the second level, wherein a sequence of the periods in the scan signal changing cycle is the data voltage maintaining period, the second data voltage maintaining period, and the data voltage changing period.

9. The method for driving a display device of claim 7, wherein the scan signal changing cycle further comprises a second data voltage changing period, and a sequence of the periods in the scan signal changing cycle is the data voltage maintaining period, the data voltage changing period, and the second data voltage changing period.

10. The method for driving a display device of claim 7, wherein the scan signal changing cycle further comprises a second data voltage changing period, and the sequence of the periods in the scan signal changing cycle is the second data voltage changing period, the data voltage maintaining period, and the data voltage changing period.

11. A method for driving a display device which comprises a data driver and N pixels, wherein each of the N pixels comprises a switching transistor, a driving transistor and a light-emitting element connected to the driving transistor in series, the method comprising:

switching a signal from a third level to a first level and providing the signal with the first level in a first scan period and maintaining the first level of the signal in the first scan period by the data driver, wherein the data signal is provided to a gate electrode of the driving transistor through the switching transistor; and changing a level of the signal from the first level to a second level to provide to the driving transistor through the switching transistor in a second scan period and changing the level of the signal from the second level to the third level in the second scan period by the data driver, wherein a time length of the first scan period is equal to a time length of the second scan period, wherein the time length of the first level and the second level of the signal is longer than the time length of the third level of the signal, wherein the scan signal in the first scan period disables the switching transistor until the scan signal in the second scan period enables the switching transistor when the level of the data signal changes from the second level to the reference level.

12. The method for driving a display device of claim 11, wherein the signal with the first level and the second level is a data signal, and the signal with the third level is a reference signal, wherein a time length of the data signal provided by the data driver is longer than a time length of the reference signal provided by the data driver in the first scan period and the second scan period.

13. The method for driving a display device of claim 11, further comprising:

providing the signal with a fourth level in a third scan period and maintaining the level of the signal in the third scan period by the data driver; and providing the signal with a fifth level in a fourth scan period and changing the level of the signal from the fifth level into a sixth level in the fourth scan period by the data driver, wherein a time length of the fourth level and the fifth level of the signal is longer than a time length of the third level of the signal, or a time length of the fourth level and the fifth level of the signal is longer than a time length of the sixth level of the signal.

14. The method for driving a display device of claim 13, wherein the signal with the first level, the second level, the fourth level and the fifth level is a data signal, and the signal with the third level and the sixth level is a reference signal, wherein a time length of the data signal between any of two adjacent reference signals provided by the data driver is longer than a time length of any reference signal provided by the data driver.

15. A display device, comprising:

a gate driver configured to provide N scan signals, where N is an integer which is larger than one;

a data driver configured to provide a reference signal; and

N pixels configured to be electrically connected to the data driver and the gate driver, wherein the N pixels are driven according to the N scan signals, and each of the N pixels comprises:

a switching transistor configured to receive the reference signal;

a driving transistor configured to be electrically connected to the switching transistor and receive the reference signal from the switching transistor; and a light-emitting element configured to be electrically connected to the driving transistor in series and driven by the driving transistor;

wherein the switching transistors of the N pixels provide the reference signal with a reference level in a first period;

wherein the data driver provides N data signals with different levels through the switching transistors to the driving transistors of the N pixels in N different periods, respectively, and at least two periods of the N different periods are connected to each other;

wherein the at least two periods connected to each other are connected to the first period, and a data signal in a period of the at least two periods connected to the first period has a level that is switched from the reference level of the reference signal in the first period; and wherein a scan signal in a first scan period disables the switching transistors of the N pixels until the scan signal in a second scan period enables the switching transistors of the N pixels when the level of the data signal changes from the second level to the reference level.

16. The display device of claim 15, wherein the time length of the at least two periods connected to each other is longer than or equal to two times the time length of the first period.

17. The display device of claim 15, wherein the switching transistors of the N pixels are configured to provide the reference signal to corresponding driving transistors in a second period according to the N scan signals and the second period is connected to the at least two periods connected to each other of the N different periods.

18. The display device of claim 15, wherein the switching transistors of the N pixels are configured to provide the reference signal to corresponding driving transistors many times in a frame cycle according to the N scan signals in a frame cycle.

* * * * *